US006691444B2

(12) United States Patent
Doone

(10) Patent No.: US 6,691,444 B2
(45) Date of Patent: Feb. 17, 2004

(54) VERSATILE STRETCHER FRAME SYSTEM

(76) Inventor: Charles Ian Doone, 3050 SW. 14th Pl., #15, Boynton Beach, FL (US) 33426

( * ) Notice: Subject to any disclaimer, the term of this patent is extended or adjusted under 35 U.S.C. 154(b) by 0 days.

(21) Appl. No.: 10/039,790

(22) Filed: Jan. 4, 2002

(65) Prior Publication Data

US 2003/0126777 A1 Jul. 10, 2003

(51) Int. Cl.[7] ..... G09F 17/00
(52) U.S. Cl. ..... 40/603
(58) Field of Search ..... 40/603

(56) References Cited

U.S. PATENT DOCUMENTS 3,591,940 A * 7/1971 Slemmons ..... 40/603
4,194,312 A * 3/1980 Connors et al. ..... 38/102.5
4,833,805 A * 5/1989 Roberson ..... 40/603
4,864,756 A * 9/1989 Rasmussen ..... 40/603
5,207,262 A * 5/1993 Rushford ..... 160/354
5,647,176 A * 7/1997 Milliken et al. ..... 52/63
6,088,942 A * 7/2000 Brooks et al. ..... 40/603
6,269,569 B1 * 8/2001 Doone ..... 40/603

* cited by examiner

*Primary Examiner*—Anthony Knight
*Assistant Examiner*—Andrea Chop
(74) *Attorney, Agent, or Firm*—Robert M. Downey, P.A.

(57) ABSTRACT

One or more frame members are assembled to provide a frame having a front face, sides and a back. The frame surrounds an area of predetermined size and configuration and is designed to accept a flexible sheet material which is pulled taut over the area and front face and around the sides of the frame. The flexible material may have art, graphics or other indicia applied to the outer exposed side and is easily secured, adjusted and removed on the back of the frame with the use of an adhesive membrane and removable clips. The assembled frame is structured to mount tightly against a flat, curved or angled (e.g. inward or outward corners) wall surface with no visible fasteners.

18 Claims, 5 Drawing Sheets

VERSATILE STRETCHER FRAME SYSTEM

BACKGROUND OF THE INVENTION

1. Field of the Invention

The present invention relates to frames for signs and art and, more particularly, to a frame system for tensioning a flexible material to a frame and including means for removably and adjustably securing the flexible material to the frame in a manner which allows the frame to be mounted tightly against a wall surface with no visible fasteners.

2. Discussion of the Related Art

It is well known in the art to stretch or tension a flexible sheet material on a frame in the construction of signs, graphic art displays, as well as the mounting of original and printed art. An example of a stretcher frame system is shown and described in my previous U.S. Pat. No. 6,269,569. Other examples of tensioning frame devices are disclosed in U.S. Pat. Nos. 5,467,546; 4,773,174; 6,163,995; 5,301,447; and 4,754,566.

SUMMARY OF THE INVENTION

The stretcher frame system of the present invention is designed for use by professional artists, sign manufacturers, interior decorators, as well as other business owners and homeowners. The frame system of the present invention is specifically designed for the easy and adjustable application and removal of artist canvas, sheet vinyl, fabric and other flexible materials to the frame in a manner which holds the flexible material taut, under tension, so that the exposed outer face of the flexible material is smooth and free of creases or wrinkles. The low profile frame structure is adapted for mounting to flat or angled walls, columns and freestanding displays. Examples of uses of the frame system of the present invention include, but are not limited to: the mounting of original art; the mounting of printed art; graphic sign arts; photo art; applied graphic arts; and sound deadening panels.

The lightweight, rigid frame members of the system are designed for interior and exterior use. The frame members may be manufactured to a specific size or cut to size for custom installation. The frame members which assemble to form a closed frame may be made in various sizes and configurations. Specifically, the frame members may be made according to various corner profiles, rail lengths, profile depths, and frame configurations, including half-round and full-round configurations. The framing system of the present invention is further provided with inside and outside corner pieces which allow the frames to be assembled so that they can run into or around building corners or columns. When assembled, the frame may be as large as a billboard or smaller than one square foot.

The assembled frame structure is designed for interior support and can accommodate a rigid backing panel such as plywood or a foam core. The rigid backing panel would be used for cleaning, bumping, etc. A rigid or soft sound deadening material may also be installed within the interior support of the frame structure. This is particularly useful for providing noise insulation on interior walls, such as in conference rooms and private offices.

The flexible material, having artwork, graphics or other indicia applied to the outer exposed side, covers the front face of the frame, wraps around the edges and sides of the frame and tucks into the corners or curves of the frame. The flexible material attaches to the back of the frame using an adhesive surface or membrane (e.g. double-faced tape) and removable clips. This unique stick and clip method of attachment allows the flexible material to be easily pulled and stretched onto the frame, adjusted and removed with no skill, thereby allowing the frame to be reused for new sheets of flexible material when changing an art or advertisement display.

The present invention contemplates many means of attaching the assembled frame to interior walls or the exterior of buildings. When it is desired to mount the frame to a surface with no visible fasteners outside of the frame, a two-piece beveled frame and wall cleat is used. Other means of attachment contemplate the use of a J-hook, an L-bracket, or an I-bracket. The frames may be hinged to the wall for accessibility or, alternatively, hinged over a light source for providing backlight to art and signs. The assembled frames of the present invention may also be attached to a mounting surface using a sub-frame. In this instance, the sub-frame is attached to the interior wall surface, exterior building surface, or light source and the outer frame, covered with the stretched flexible material, snaps into place over the sub-frame.

BRIEF DESCRIPTION OF THE DRAWINGS

For a fuller understanding of the nature of the present invention, reference should be made to the following detailed description taken in conjunction with the accompanying drawings in which.

DETAILED DESCRIPTION OF THE PREFERRED EMBODIMENTS

Referring to FIGS. 1–14B, several embodiments of the stretcher frame system of the present invention are shown and described. In each of the embodiments the stretcher frame system is indicated as 10. According to the invention, frame members are assembled to provide a frame 12 which surrounds an area of predetermined size and configuration. The frame 12 is designed to accept a flexible sheet material 14 which is pulled taut over the area, front face 16 and sides 18 of the frame 12, as described more fully hereinafter.

Figure 1A:
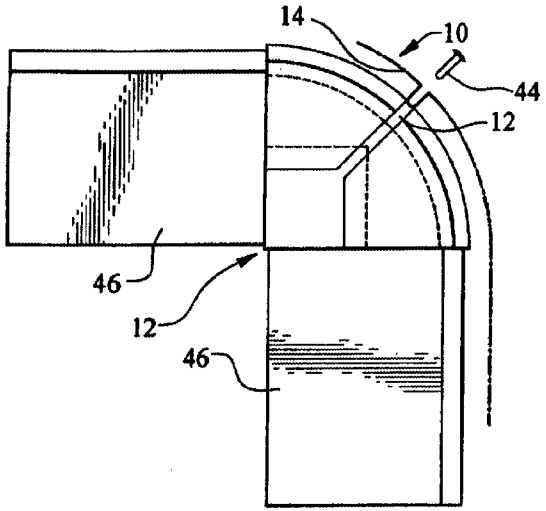
FIG. 1A is a back plan view of a quarter-round corner piece of the frame system in accordance with one embodiment thereof.
Figure 3B:
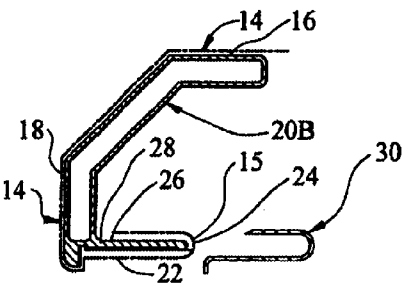
FIG. 3B is an end elevational view of a square beveled rail frame member for use in combination with the corner piece of FIG. 3A in the assembly of a frame.
Figure 1B:
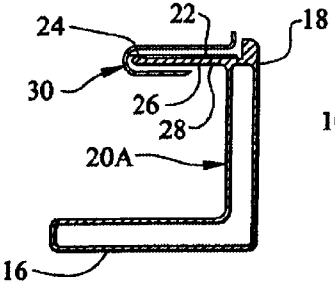
FIG. 1B is an end elevational view of a square rail frame member of the frame system for use in combination with the corner piece of FIG. 1A in the assembly of a frame.

In FIG. 1B, a square rail frame member 20*a* is provided with an adhesive membrane 22 on one or both of opposite surfaces 24, 26 of the back 28 of the frame member. The adhesive surface of the membrane 22 allows the outer periphery 15 of the stretched flexible sheet material 14 to be secured to the frame member 20*a*, and adjustably positioned, prior to securing the flexible material to the back 28 of the frame member 20*a* with a removable clip 30, as seen in FIG. 3B. The square rail frame member in FIG. 1B is adapted for attachment with a congruent corner piece such as the quarter-round corner piece 40*a* shown in FIG. 1A. The quarter-round corner piece 40*a* is provided with a slot 42 for tucking in the flexible material 14 after stretching the flexible material about the front face 16 and sides 18 of the assembled frame 12. A corner cap 44 is inserted within the slot 42 to hold the tucked flexible material within the slot. The square rail frame member 20*a* of FIG. 1B is adapted to slide onto one of the leg members 46 of the corner piece of FIG. 1A so that the sides and front face of the square rail frame member are flush with the exterior side and front surfaces of the quarter-round corner piece.

Figure 2:
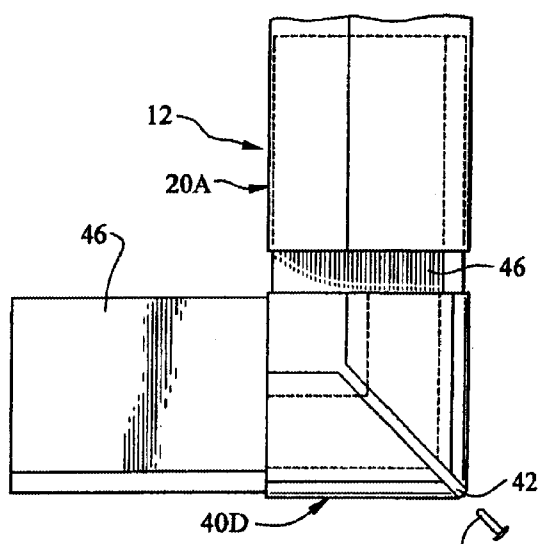
FIG. 2 is a back plan view showing the square rail frame member of FIG. 1B fitted to a square corner piece of the frame system of the present invention, in accordance with another embodiment of the present invention.

FIG. 2 shows a back view of a square rail frame member 20*a* and square corner piece 40*d* being assembled, wherein the square rail frame member 20*a* is being slid onto one of the leg members 46 of the square corner piece 40*d*. It should be noted that the various embodiments of rail frame members and corner pieces described herein are assembled in the same manner as illustrated in FIG. 2.

Figure 3A:
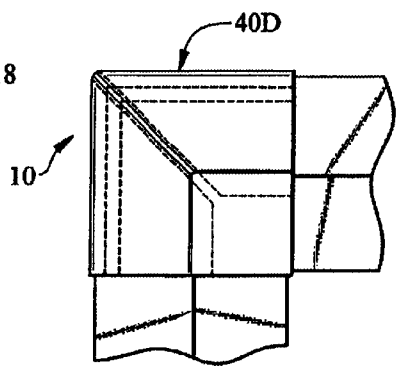
FIG. 3A is a back plan view of a square beveled corner piece of the frame system in accordance with another embodiment of the present invention.

Referring to FIGS. 3A and 3B, a square beveled rail frame member 20*b* and square beveled corner piece 40*b* are shown. In FIG. 3B, the flexible sheet material 14 is shown wrapped about the front 16, sides 18 and back 28 of the square beveled rail frame member 20*b* and in overlapping engagement with the adhesive membrane 22 on the back 28 of the frame member. Once the flexible sheet material 14 is pulled tight, adjusted and secured to the adhesive membrane 22, the clip 30 shown in FIG. 3B is attached over the flexible sheet material on the back 28 of the frame member, to secure the flexible sheet material to the frame 12.

Figure 4B:
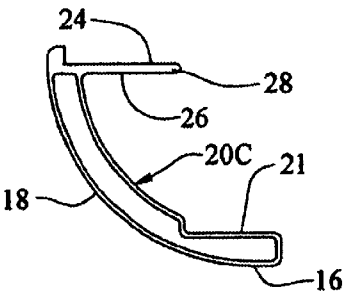
FIG. 4B is an end elevational view of a quarter-round rail frame member for use in combination with the round corner piece of FIG. 4A in the assembly of a frame.
Figure 4A:
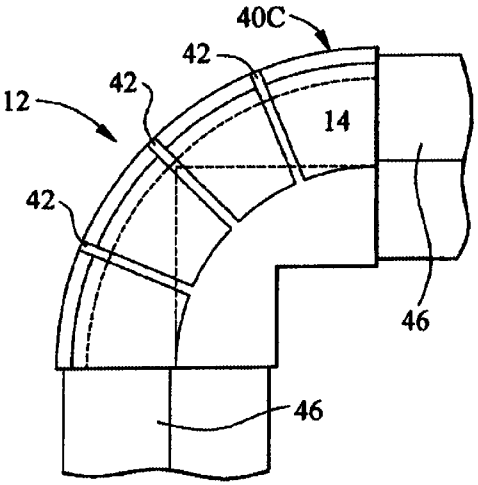
FIG. 4A is a back plan view of a round corner piece of the frame system of the present invention in accordance with yet another embodiment thereof.
Figure 11:
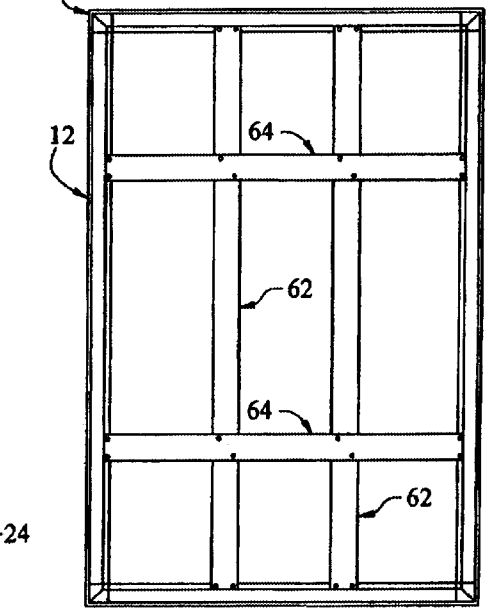
FIG. 11 is a back plan view of the assembled frame of FIG. 10 showing vertical supports and a frame cleat for mounting the frame to the wall.

FIGS. 4A and 4B show a quarter-round rail frame member 20*c* and a rounded corner piece 40*c*. The quarter-round rail frame member 20*c* in FIG. 4B is structured for attachment to the rounded corner piece 40*c* of FIG. 4A. As seen in FIG. 4B, the back side of the rounded rail frame member 20*c* is notched at 21 for attached receipt of a vertical support, as shown in FIG. 11. The flexible sheet material 14 is secured to the quarter-round rail frame member 20*c* in the same manner as described in connection with FIGS. 1A–3B (i.e. using the adhesive membrane 22 and clip 30). The rounded corner piece 40*c* is provided with several tuck slots 42 for tucking excess material of the flexible sheet material 14 when the flexible sheet material is pulled tight around the assembled frame, thereby removing sags, creases and wrinkles. A cap 44 (as shown in FIGS. 1A and 2) is inserted within each of the tuck slots 42, to hold the flexible sheet material therein, in the same manner as described in connection with FIG. 1A.

Figure 5B:
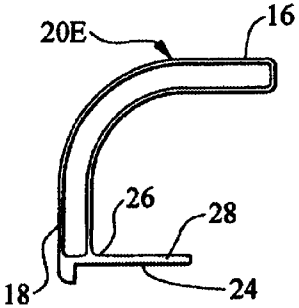
FIG. 5B is an end elevational view of a quarter-round beveled rail frame member for use in combination with the corner piece of FIG. 5A in the assembly of a frame.
Figure 5A:
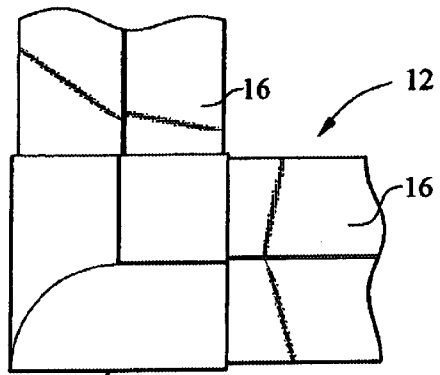
FIG. 5A is a front plan view of a quarter-round beveled corner piece of the frame system of the present invention, in accordance with yet another embodiment thereof.

FIGS. 5A and 5B show a front view of yet another embodiment of the rail frame member and corner piece profiles. Specifically, FIGS. 5A and 5B show a quarter beveled rail frame member 20*e* and a quarter-round beveled square corner piece 40*e* which attach to one another to assemble the frame 12. The flexible sheet material 14 is secured to the quarter beveled rail frame members 20*e* and the quarter-round beveled square corner piece 40*e* in the same manner as described above in connection with other embodiments.

Figure 6:
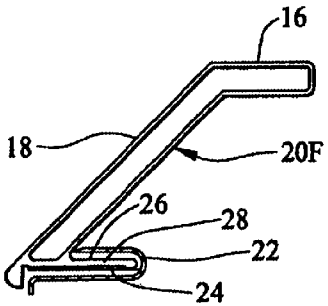
FIG. 6 is an end elevational view of a full square beveled rail frame member in accordance with yet another embodiment of the frame system of the present invention.

FIG. 6 shows another embodiment of a rail frame member. Specifically, a full beveled rail frame member 20*f* is shown with the back portion 28 of the frame rail member having the adhesive membrane 22 for attachment of the outer periphery 15 flexible sheet material 14 in the same manner as described above.

Figure 7:
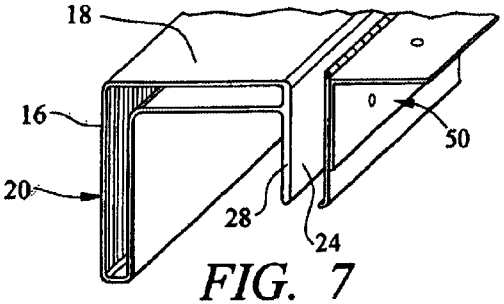
FIG. 7 is an end perspective view of a hinged rail frame member with a hinge.
Figure 8:
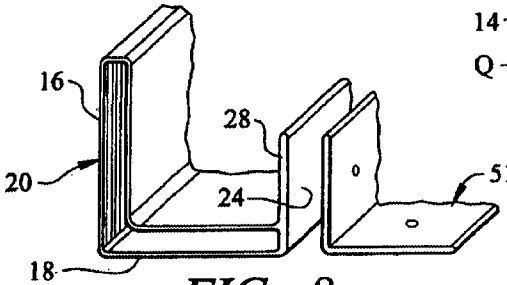
FIG. 8 is an end perspective view of a hinged rail frame member with an L-bracket.
Figure 9:
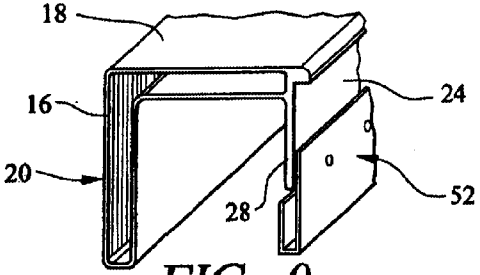
FIG. 9 is an end perspective view of a square rail frame member with a J-bracket.

FIGS. 7 and 8 show an end perspective view of a rail frame member 20 which is specifically adapted for attachment of a hinge 50 or L-bracket 51 to the back surface. In this embodiment, the hinge, L- or I-bracket 50 are fastened onto the back surface 24, at the location of the adhesive membrane. The hinge or bracket 50 can then be fastened to a wall or light source, thereby allowing hinged movement of the frame 12 away from the wall or light source for repairs, cleaning, replacement of the flexible sheet material 14, etc. FIG. 9 shows a square rail frame member aligning with a J-strip 52, demonstrating an alternative means of attaching the frame 12 to a wall or light source.

Figure 10:
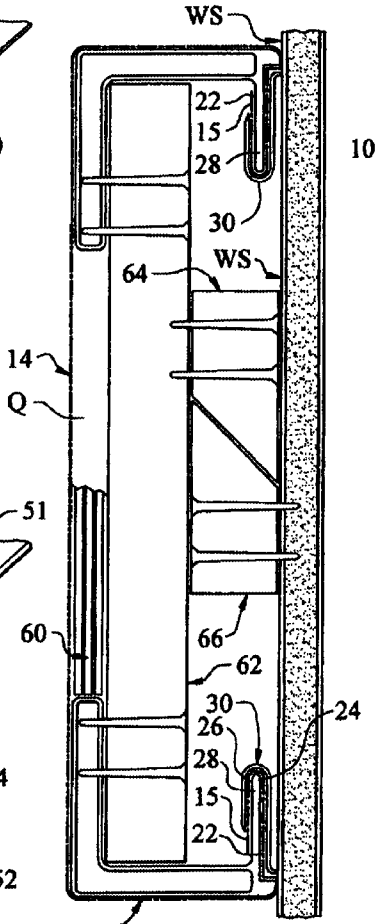
FIG. 10 is a cross-section of a square rail assembled frame structure show n mounted to a wall and having a flexible sheet material stretched and secured to the frame structure, a rigid backing, and wall and frame cleats for mounting the frame structure tightly against the wall.

In FIG. 10, an example of mounting the assembled stretcher frame system 10 to a wall surface WS is shown. Specifically, the flexible sheet material 14 is shown wrapped around the assembled frame 12 and attached to the frame using the adhesive membrane 22 and clip 30 (i.e. stick and clip) system, as described above. The space Q behind the flexible sheet material may be filled with a hard or soft backing 60. Specifically, a hard backing may be provided behind the flexible sheet material to make it easier to clean the exposed front surface of the flexible sheet material. Alternatively, a soft backing may be provided behind the flexible sheet material for soft touch and/or sound deadening purposes. Vertical supports 62 may further be provided for attachment to the inside of the frame 12. The assembled frame structure can then be mounted to the wall using frame cleats 64 and wall cleats 66. Specifically, the frame cleats 64 attach to the vertical supports 62 on the back of the assembled frame structure 12. The wall cleats 66 are attached to the wall surface WS or columns of a building structure. Once the frame and wall cleats are attached, the frame 12 is placed against the wall surface WS and lowered so that the frame cleats 64 mate with the wall cleats 66, thereby holding the frame tightly to the wall without any visible fasteners. A back plan view of the assembled frame structure 12 is shown in FIG. 11 illustrating the vertical supports and frame cleats 64.

Figure 12:
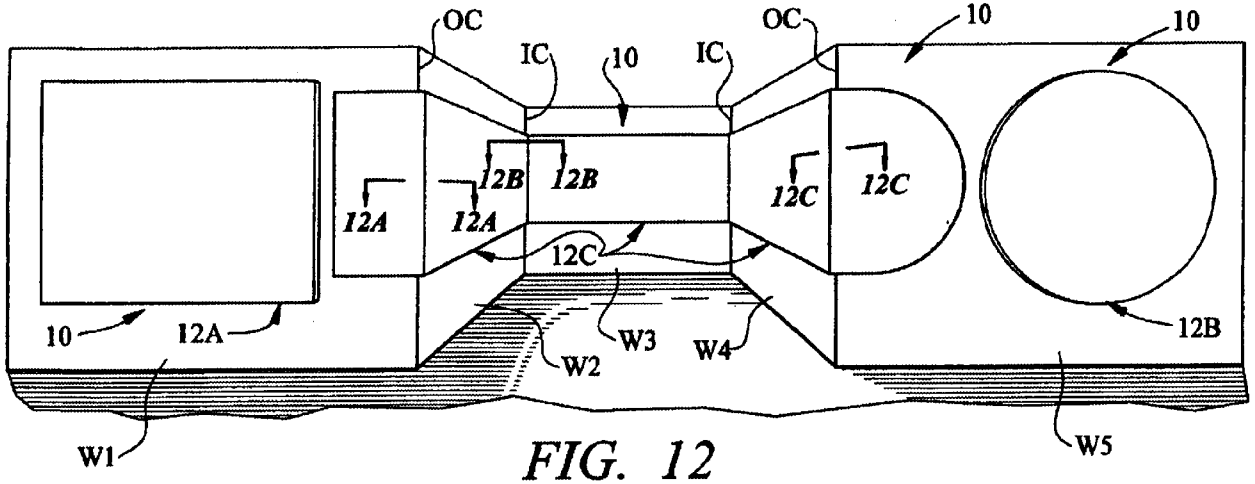
FIG. 12 is a front elevational view of a wall having angled wall surfaces forming outward and inward corners between adjacent wall surfaces, and wherein various embodiments of the stretcher frame system are shown mounted to the various angled wall surfaces.

FIG. 12 illustrates various embodiments of the stretcher frame system 10 mounted to walls of a building structure. In this example, wall sections W1, S2, S3, S4 and W5 are angled relative to one another to form an open-ended room (i.e. three walls) extending inwardly from a larger room or a corridor. This is an example of a wall configuration which is typically found in an art gallery, hotel lobby or other interior building structure. As seen, the wall configuration in FIG. 12 includes outside corners OC and inside corners IC between adjacent wall sections. The stretcher frame system 10, and attached flexible sheet material 14, is shown mounted to and wrapping about the adjacent wall sections W1–W5. Specifically, the frame system is shown to wrap around the outside ninety-degree corners OC as well as the inside ninety-degree corners IC between the adjacent wall sections. FIG. 12 also shows a single mounted square frame assembly 12*a* and a full round frame assembly 12*b*. Additionally, FIG. 12 shows an embodiment of the frame assembly 12*c* extending around the ninety-degree outside corner and going into a half-round rail frame member 20'.

Figure 12C:
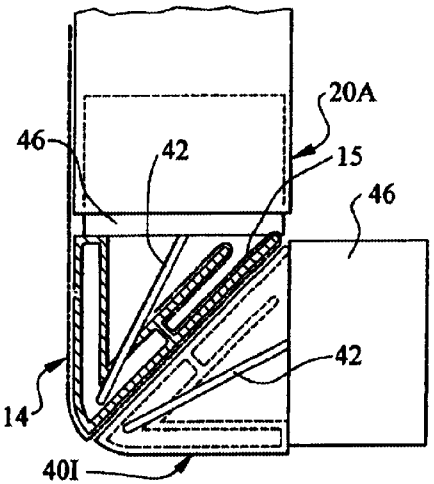
FIG. 12C is an isolated cross-sectional view taken from the area indicated as 12C in FIG. 12 showing a top plan view of a two-piece outside corner piece of the frame system.
Figure 12B:
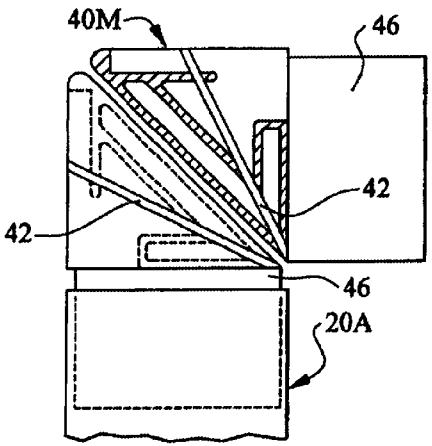
FIG. 12B is an isolated sectional view taken from the area indicated as 12B in FIG. 12, showing a top plan view of a two-piece inside corner piece of the frame system.
Figure 12A:
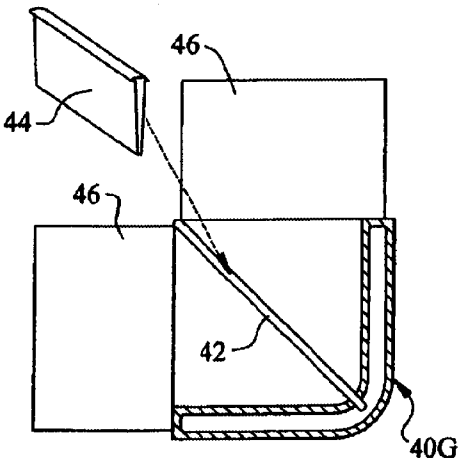
FIG. 12A is an isolated sectional view taken from the area indicated as 12A in FIG. 12, showing a top plan view of an outside continuous one-piece square corner of the frame system.

FIGS. 12A–12C are taken from various areas of FIG. 12 as indicated. Specifically, FIG. 12A shows a detailed section of a continuous, one-piece ninety-degree outside corner piece 40*g*. FIG. 12B shows a two-piece inside ninety-degree corner piece 40*h* shown with the square rail frame member 20*a* attached thereto. Two corner rails (one for each side of the corner) are required when building an inside ninety-degree corner. In FIG. 12C, a two-piece outside ninety-degree corner piece 40*i* is shown with a square rail frame member 20*a* attached thereto. The attachment of the flexible sheet material 14 is further illustrated in FIG. 12C, using the stick and clip method described above.

Figure 13B:
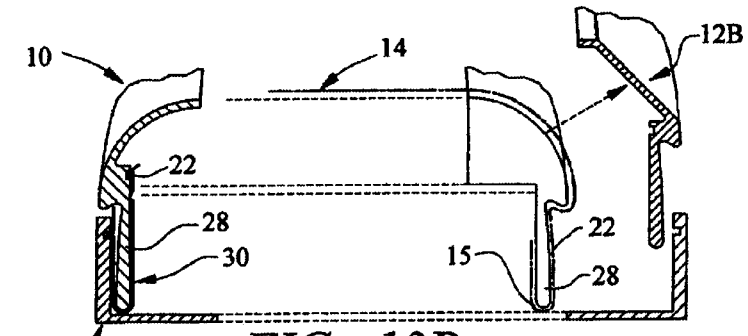
FIG. 13B is a cross-sectional view of the round frame and sub-frame of FIG. 13A.
Figure 13A:
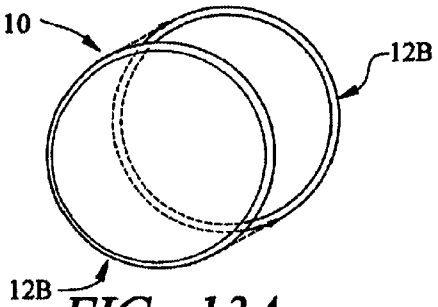
FIG. 13A is an exploded front plan view of a round frame and sub-frame in accordance with yet another embodiment of the present invention.

FIG. 13A shows a front view of a round frame 12*b* aligning with a round sub-frame 12*b*'. In FIG. 13B, a section of the round frame is shown to illustrate two different rail profiles. Once the flexible sheet material 14 is attached to the outer round frame 12*b*, the outer round frame 12*b* is clipped into the sub-frame 12*b*'. The sectional view in FIG. 13B illustrates how the outer round frame 12*b* clips into the sub-frame 12*b*' once the flexible sheet material 14 is attached to the outer round frame and secured using the stick and clip system as described above.

Figure 14:
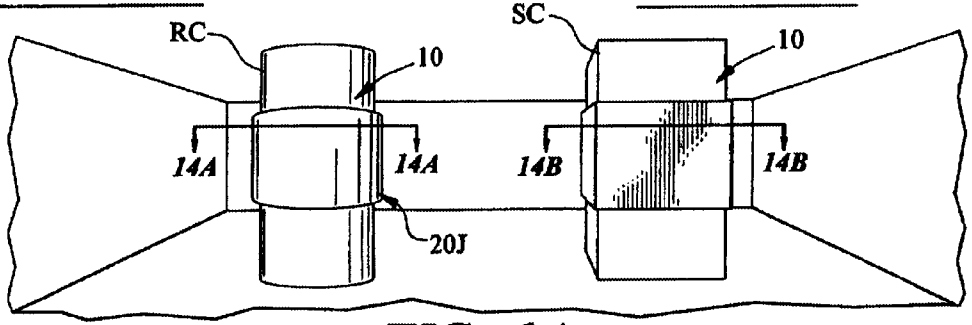
FIG. 14 is an elevational view of a room showing various embodiments of the frame system of the present invention mounted to both a round column and a square column.

FIG. 14 shows examples of further embodiments of the stretcher frame system 10 for attachment to either a round column RC or a square column SC. In FIG. 14A, a sectional view is shown of an embodiment of the stretcher frame system attached about a round column RC. In this embodiment, two half-round rail frame members 20*j* are provided. Wall cleats 66' attached to the column and the two halves of the frames come together so that the frames attach to the column in the same general manner as described above in connection with the description of the flat frame attachment to a wall surface.

Figure 14B:
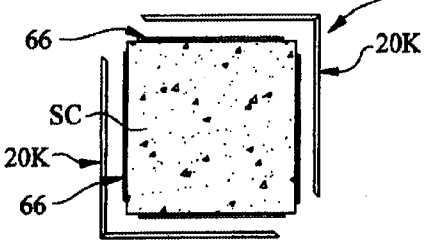
FIG. 14B is a cross-sectional view of the square column of FIG. 14 showing another embodiment of the frame system of the present invention which is structured to mount about the four outer faces of the square column.
Figure 14A:
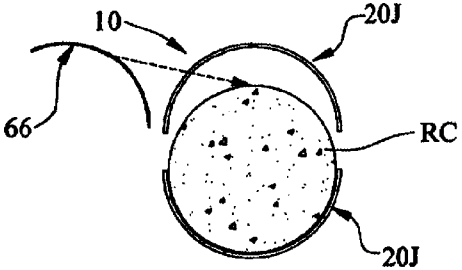
FIG. 14A is a cross-sectional view of the round column of FIG. 14 showing one embodiment of the frame system of the present invention which is structured to mount about the round column.

In FIG. 14B, another embodiment of the stretcher frame system 10 is shown for attachment to a square column SC. Specifically, wall cleats 66 are attached to the square column SC and two square frame rail assemblies 20*k*, each having continuous corners to form an L-shape, are attached to the columns SC so that the assembled frame structure extends about the four surfaces of the column.

While the instant invention has been shown and described in connection with several preferred and practical embodiments thereof, it is recognized that departures from the instant disclosure are contemplated within the spirit and scope of the invention as set forth in the following claims and under the doctrine of equivalents.

What is claimed is:

1. A stretcher frame system for mounting a flexible sheet material thereto, said system comprising:

at least one rail frame member having a front face, a side and a back portion;

an adhesive substance on said back portion for releasably holding the flexible sheet material on said back portion of said rail frame member and allowing the flexible sheet material to be selectively released from said rail frame member to be stretched, pulled taut, adjusted and reapplied to said adhesive substance; and clip means structured for removable attachment to said back portion for gripping and holding said flexible sheet material on said adhesive substance and said rail frame member.

2. The system as recited in claim 1 further comprising a plurality of said rail frame members structured for interconnection to form an assembled frame structure.

3. The system as recited in claim 2 wherein said assembled frame structure surrounds an area to be covered by said flexible sheet material.

4. The system as recited in claim 3 wherein said back portion of each of said plurality of said rail frame members includes a flat surface.

5. The system as recited in claim 4 wherein said adhesive substance is provided on said flat surface.

6. The system as recited in claim 3 wherein said back portion of each of said plurality of said rail frame members includes a first flat surface and an opposite second flat surface.

7. The system as recited in claim 6 wherein said adhesive substance is provided on said first flat surface and said opposite second flat surface of said back portion.

8. The system as recited in claim 6 wherein said clip means includes at least one removable clip structured and disposed for snug fitted, grasping attachment over said first and second surfaces of said back portion.

9. The system as recited in claim 8 further comprising a plurality of corner pieces structured and disposed for interconnection with said plurality of said rail frame members to form said assembled frame structure.

10. The system as recited in claim 9 wherein each of said plurality of corner pieces includes at least one slot structured and disposed for tucking said flexible sheet material therein to secure said flexible sheet material to said corner piece.

11. The system as recited in claim 10 further comprising caps structured for snug fitted receipt within said slots of said plurality of corner pieces for holding said flexible sheet material securely tucked within said slots.

12. A stretcher frame system for mounting a flexible sheet material thereto, said system comprising:

at least one rail frame member having a front face, a side, and a back portion;

an adhesive membrane on said back portion for releasably holding the flexible sheet material on said back portion of said rail frame member, said adhesive membrane being structured and disposed to permit selective removal of the flexible sheet material to stretch, adjust and reapply the flexible sheet material to said adhesive membrane, thereby allowing the flexible sheet material to be pulled taut over the front face and over the side of the rail frame member;

at least one removable clip structured for removable attachment to said back portion for gripping and holding said flexible sheet material on said adhesive membrane and said rail frame member.

13. The system as recited in claim 12 further comprising a plurality of said rail frame members structured for interconnection to form an assembled frame structure.

14. The system as recited in claim 13 further comprising a plurality of corner pieces structured and disposed for interconnection with said plurality of said rail frame members to form said assembled frame structure.

15. The system as recited in claim 14 wherein each of said plurality of corner pieces includes at least one slot structured and disposed for tucking said flexible sheet material therein to secure said flexible sheet material to said corner piece.

16. The system as recited in claim 15 further comprising caps structured for snug fitted receipt within said slots of said plurality of said corner pieces for holding said flexible sheet material securely tucked within said slots.

17. A stretcher frame system for mounting a flexible sheet material thereto, said system comprising:

at least one rail frame member having a front face, a side, and a back portion;

adhesive means on said rail frame member for releasably holding the flexible sheet material on said rail frame member and said adhesive means being structured and disposed to allow the flexible sheet material to be selectively released from said rail frame member in order to stretch, pull taut, adjust and reapply the flexible sheet material to said adhesive means on said rail frame member; and at least one clip structured for removable attachment to said rail frame member for gripping and holding said flexible sheet material on said adhesive means and said rail frame member.

18. The system as recited in claim 17 further comprising a plurality of said rail frame members structured for interconnection to form an assembled frame structure.

* * * * *